US009717373B2

(12) United States Patent
Andrews et al.

(10) Patent No.: US 9,717,373 B2
(45) Date of Patent: Aug. 1, 2017

(54) TUBULAR TOOTHPASTE TUBE STAND WITH BRUSHING TIMER

(71) Applicants: Daniel Patrick Andrews, Westminster, MD (US); Amy Lynne Andrews, Westminster, MD (US)

(72) Inventors: Daniel Patrick Andrews, Westminster, MD (US); Amy Lynne Andrews, Westminster, MD (US)

( * ) Notice: Subject to any disclaimer, the term of this patent is extended or adjusted under 35 U.S.C. 154(b) by 35 days.

(21) Appl. No.: 14/672,265

(22) Filed: Mar. 30, 2015

(65) Prior Publication Data

US 2016/0287028 A1 Oct. 6, 2016

(51) Int. Cl.

| | |
|---|---|
| ***B65D 35/56*** | (2006.01) |
| ***A47K 5/18*** | (2006.01) |
| ***B65D 35/24*** | (2006.01) |
| ***B65D 35/04*** | (2006.01) |
| ***G04F 1/06*** | (2006.01) |
| ***A47K 1/09*** | (2006.01) |

(52) U.S. Cl.

CPC ..... *A47K 5/18* (2013.01); *A47K 1/09* (2013.01); *B65D 35/04* (2013.01); *B65D 35/24* (2013.01); *B65D 35/56* (2013.01); *G04F 1/06* (2013.01)

(58) Field of Classification Search

CPC . A47K 5/18; A47K 5/16; B65D 35/04; B65D 35/24; B65D 35/26; G04F 1/06; G04F 1/09

USPC ..... 222/105

See application file for complete search history.

(56) References Cited

U.S. PATENT DOCUMENTS

| | | | | |
|---|---|---|---|---|
| 1,923,978 | A * | 8/1933 | Hill | A47K 1/09 211/65 |
| D99,443 | S | 4/1936 | Levy | |
| 2,432,764 | A | 12/1947 | Jenkins | |
| D155,372 | S | 9/1949 | Whitman | |
| D175,924 | S | 11/1955 | Aul | |
| 3,125,849 | A * | 3/1964 | Wachtel | G04F 1/06 368/93 |
| D198,777 | S | 8/1964 | Shelane et al. | |
| D239,799 | S | 5/1976 | Fentules | |
| 4,219,035 | A | 8/1980 | Deconick | |
| 4,248,361 | A | 2/1981 | Moyle | |
| 4,836,415 | A | 6/1989 | Grussmark | |
| D306,811 | S | 3/1990 | DeLeon | |
| D312,182 | S | 11/1990 | Ritchie | |

(Continued)

OTHER PUBLICATIONS

Through an Internet search on "toothpaste tube stand" I discovered: www.thingiverse.com/thing:129231.

(Continued)

*Primary Examiner* — Patrick M Buechner
*Assistant Examiner* — Jeremy W Carroll

(57) ABSTRACT

A rigid material, preferably recycled plastic, Tubular Toothpaste Tube Stand with Brushing Timer is a countertop dental hygiene appliance. It is comprised of a vertically arranged, open top and open bottom, tubular toothpaste tube stand with an attached, stationary, sand/oil liquid timer hourglass to provide the user a visual gauge to determine elapsed brushing time. The appliance also assists with concentrating toothpaste, within the toothpaste tube, toward the tube's nozzle end. Also, the appliance can be made into various decorative shapes, and, can employ decorative graphics to attract users. It can be easily assembled as well.

5 Claims, 6 Drawing Sheets

(56) References Cited

U.S. PATENT DOCUMENTS

| | | | | | |
|---|---|---|---|---|---|
| D314,109 | S | | 1/1991 | Jordan | |
| 4,995,511 | A | | 2/1991 | Evans | |
| 5,023,852 | A | * | 6/1991 | Mikels | G04F 1/06 368/93 |
| D324,792 | S | | 3/1992 | McElroy | |
| D325,149 | S | | 4/1992 | Ancona et al. | |
| 5,480,027 | A | * | 1/1996 | Leonard | A47K 1/09 206/362.1 |
| 5,484,065 | A | * | 1/1996 | Davoli, Jr. | A47K 1/09 211/2 |
| 5,522,497 | A | | 6/1996 | Stacy | |
| 5,570,325 | A | * | 10/1996 | Arpadi | A46B 15/0002 222/192 |
| 5,673,880 | A | | 10/1997 | Dexter, Jr. | |
| D389,686 | S | | 1/1998 | Drage | |
| D405,613 | S | * | 2/1999 | Krainsky | D4/108 |
| D413,033 | S | | 8/1999 | Harris | |
| 6,056,159 | A | | 5/2000 | Layer | |
| D440,090 | S | | 4/2001 | Lillelund et al. | |
| 6,253,931 | B1 | | 7/2001 | Starkey | |
| 6,382,579 | B1 | | 5/2002 | Kenniston | |
| 6,994,212 | B2 | * | 2/2006 | Bar Noy | A47K 1/09 206/209.1 |
| D527,560 | S | | 9/2006 | Bar Noy | |
| 7,246,709 | B2 | | 7/2007 | Kim | |
| 7,299,922 | B2 | | 11/2007 | Ceballos | |
| 2004/0050733 | A1 | | 3/2004 | Page | |

OTHER PUBLICATIONS

Through an Internet search on “toothpaste tube stand” I discovered: www.thingiverse.com/thing:1302996.
Through an Internet search on “toothpaste tube stand” I discovered: www.thingiverse.com/thing:1323394.

* cited by examiner

TUBULAR TOOTHPASTE TUBE STAND WITH BRUSHING TIMER

BACKGROUND OF THIS INVENTION

This invention relates to a dental hygiene appliance. Specifically, this invention relates to a Tubular Toothpaste Tube Stand with Brushing Timer which provides two primary functions, viz; vertical toothpaste tube placement and a tooth brushing timer. To extract toothpaste from a toothpaste tube, the toothpaste must be extruded through the tube's nozzle end using applied pressure on the tube's exterior. When not in use, toothpaste tubes are often laid horizontally, which does not necessarily concentrate the toothpaste, within the tube, toward the nozzle end of the tube. Hence, vertical downward nozzle end toothpaste tube placement assists with concentrating the toothpaste, within the tube, toward the nozzle end of the tube by gravity, and vertical, downward nozzle end tube positioning also conveniently arranges the tube whereby the user may apply grasping pressure to the tube's heat-fused end, thereby further concentrating the toothpaste toward the tube's nozzle end.

According to the American. Dental Association, proper teeth-brushing and teeth-cleaning is good dental hygiene and is most effective when sustained brushing occurs over a time period of approximately two minutes. Accordingly, a sand/oil liquid timer hourglass is attached to, and stationary on, the tubular toothpaste tube stand and provides the user a visual gauge to determine elapsed brushing time. The inventor chose to offer a simplistic open top and open bottom tubular design whereby the attached and stationary sand/oil liquid timer hourglass is activated by vertically rotating the entire appliance 180 degrees, and, the appliance is easy to manufacture and use.

Therefore, the principle objective of the present invention is to provide an open top and open bottom tubular toothpaste tube stand with an attached sand/oil liquid timer hourglass, which is intended to assist people while timing their brushing routine.

Another objective of the present invention is to provide an open top and open bottom tubular toothpaste tube stand which assists in concentrating the toothpaste, within the toothpaste tube, toward the tube's nozzle end, for readily dispensing the toothpaste.

Another objective of the present invention is to provide an open top and open bottom tubular stand which accepts a plurality of toothpaste tube lengths.

Another objective of the present invention is to provide an open top and open bottom tubular stand which accepts a plurality of toothpaste tube nozzle end caps.

Another objective of the present invention is to provide an open top and open bottom tubular toothpaste tube stand of various shapes.

Another objective of the present invention is to provide a decorative open top and open bottom tubular toothpaste tube stand.

Another objective of the present invention is to provide a decorative open top and open bottom tubular toothpaste tube stand which attracts children and young adults.

Another objective of the present invention is to provide an open too and open bottom tubular toothpaste tube stand and timer assembly kit for interactive learning for school children during health related classes.

Another objective of the present invention is to promote proper dental hygiene.

Another objective of the present invention is to provide a recyclable plastic open top and open bottom tubular toothpaste tube stand.

Another objective of the present invention is to provide a ceramic open top and open bottom tubular toothpaste tube stand.

Lastly, another objective of the present invention is to provide an easily cleaned open top and open bottom tubular toothpaste tube stand.

BRIEF DESCRIPTION OF THE INVENTION

The Tubular Toothpaste Tube Stand with Brushing Timer is a practical and decorative bathroom countertop appliance which may aid with proper dental hygiene. It provides for vertical placement of a toothpaste tube to facilitate the concentration of toothpaste, within the toothpaste tube, toward the tube's nozzle end. The conveniently attached and stationary sand/oil liquid timer hourglass-brushing timer is actuated by rotating the entire tubular toothpaste tube stand vertically 180 degrees. The sand/oil liquid timer hourglass provides the user a Visual gauge to determine elapsed brushing time. Also, the open top and open bottom design allows for easy cleaning when compared to enclosed bottom toothpaste tube stands And, the design allows for decorative graphics to be placed on the stand's front and rear exterior surfaces to attract users.

DESCRIPTION OF THE INVENTION

Figure 1:
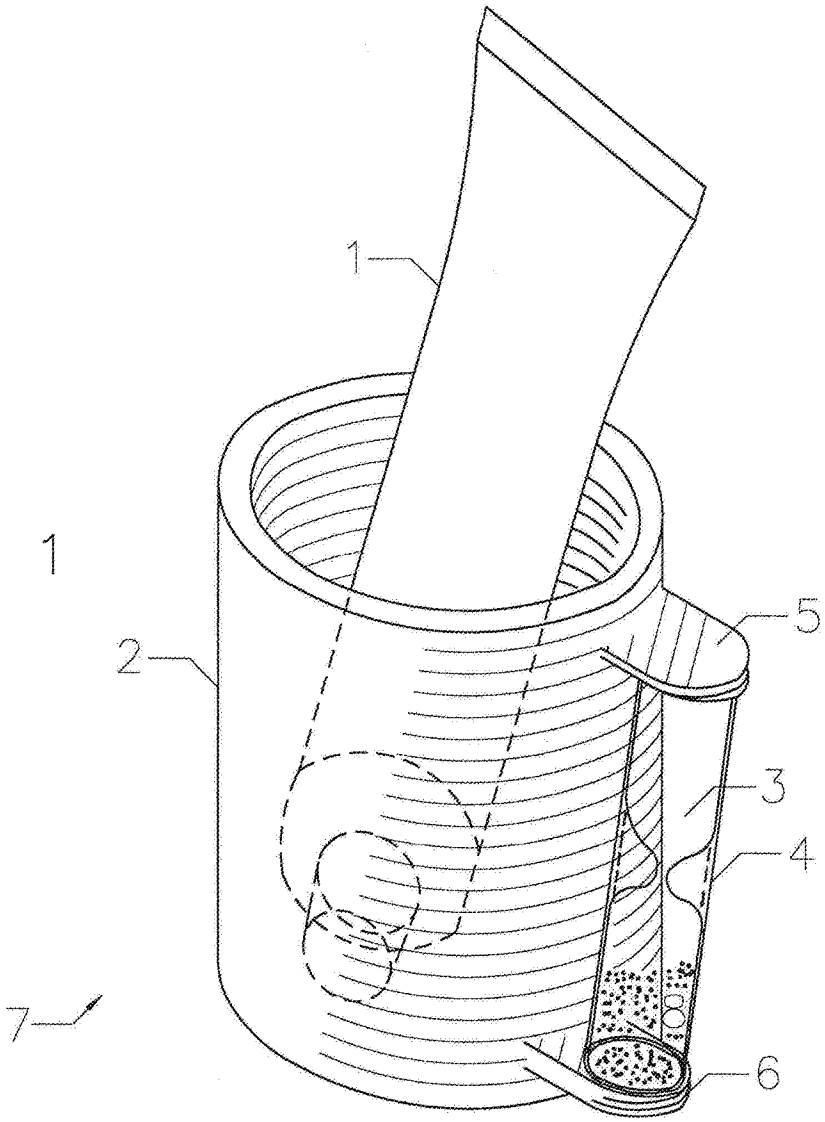
FIG. 1 is shown on sheet numbered 1-6 as a front page perspective view of the Tubular Toothpaste Tube Stand with Brushing Timer with a vertically standing toothpaste tube.
Figure 2:
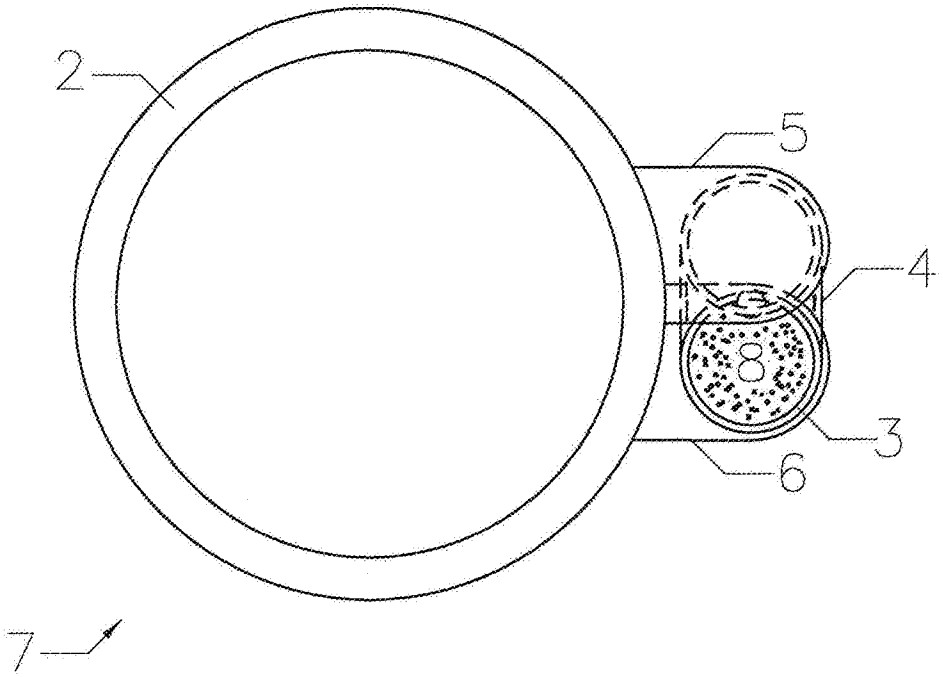
FIGS. 2, 3, 4, and 5 are shown on sheets numbered 2-6, 3-6, 4-6 and 5-6 as plan view top, elevation view front, elevation view side, and perspective view, respectively, of the Tubular Toothpaste Tube Stand with Brushing Timer.
Figure 3:
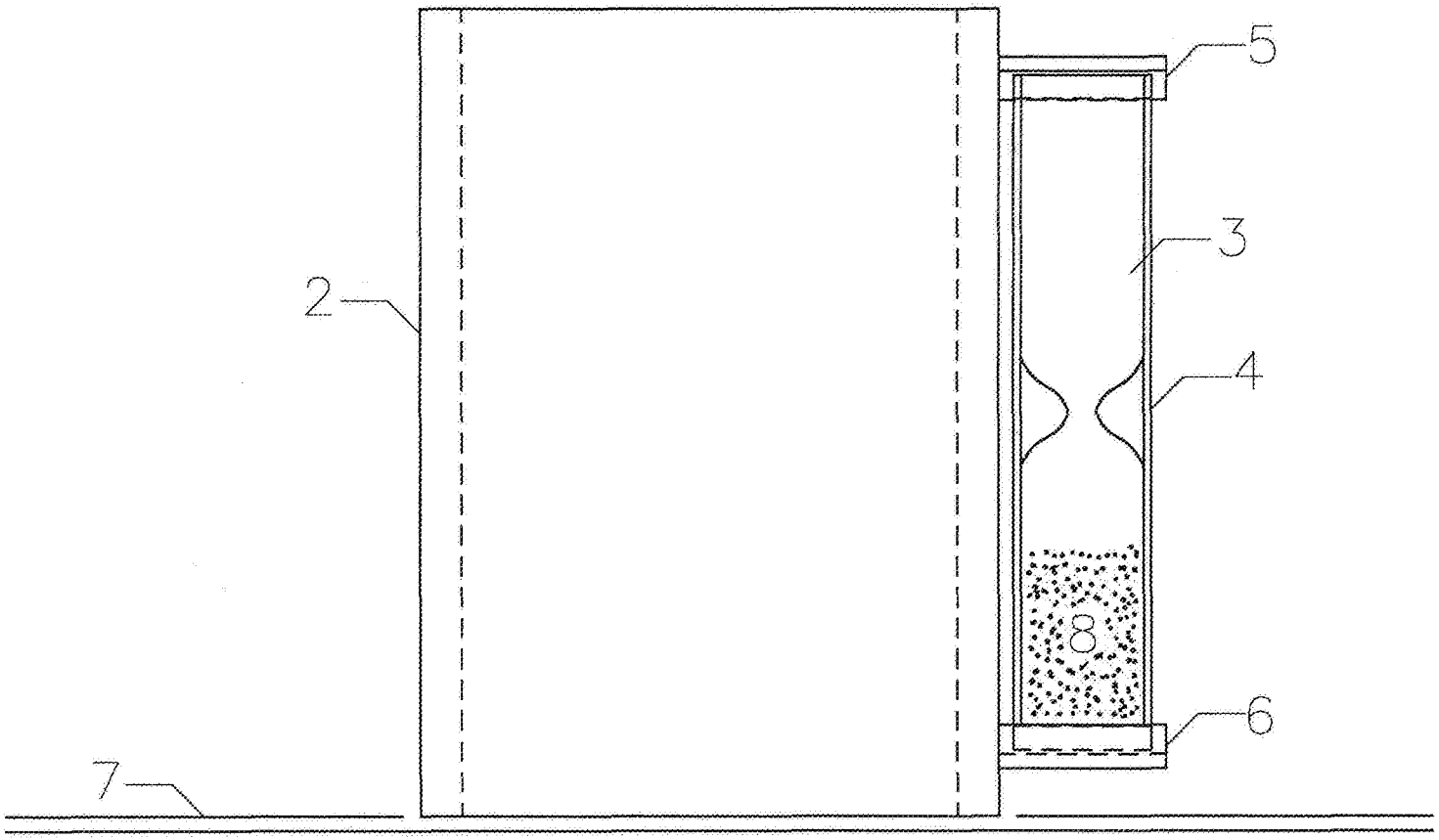
Figure 4:
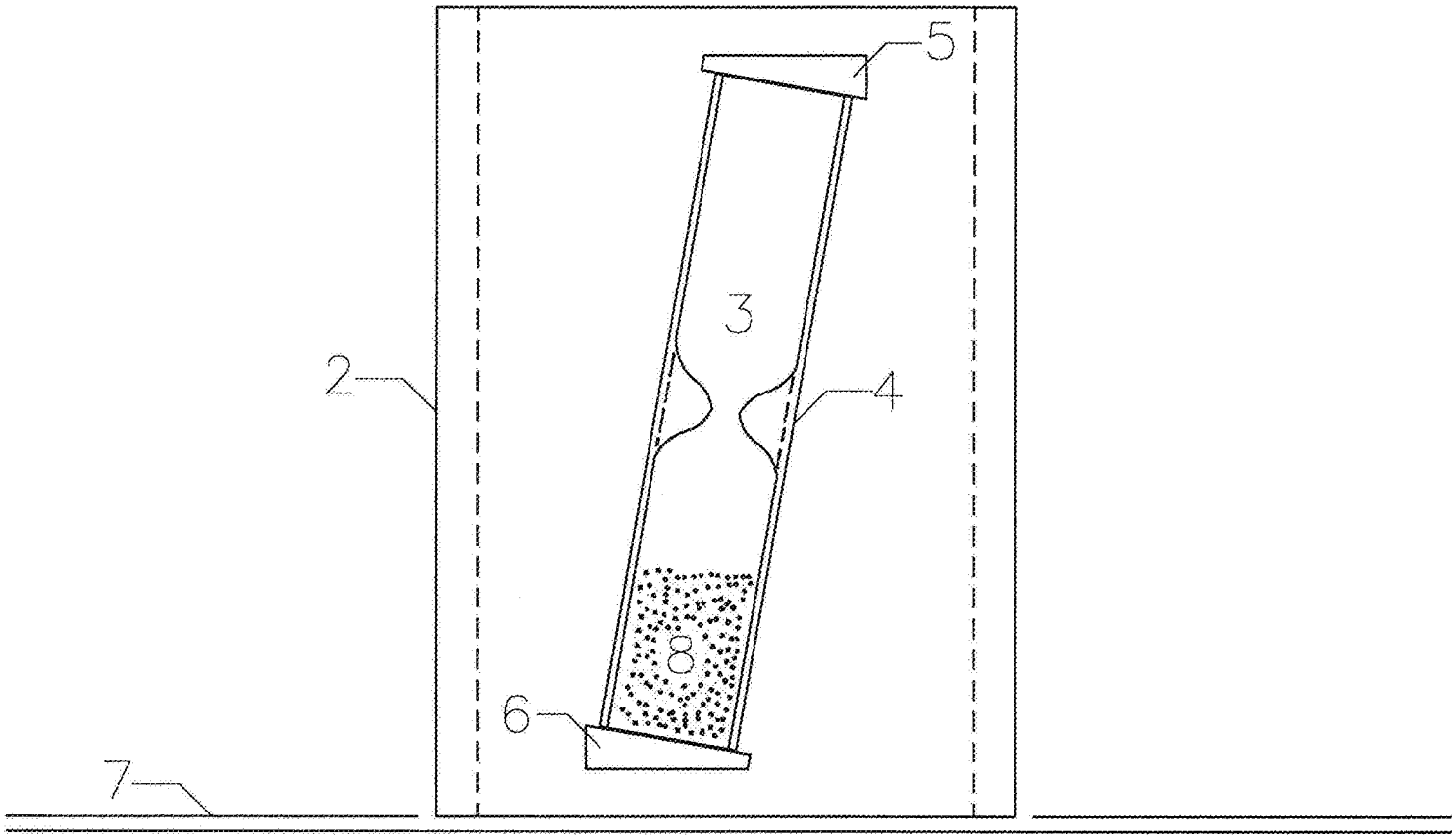
Figure 5:
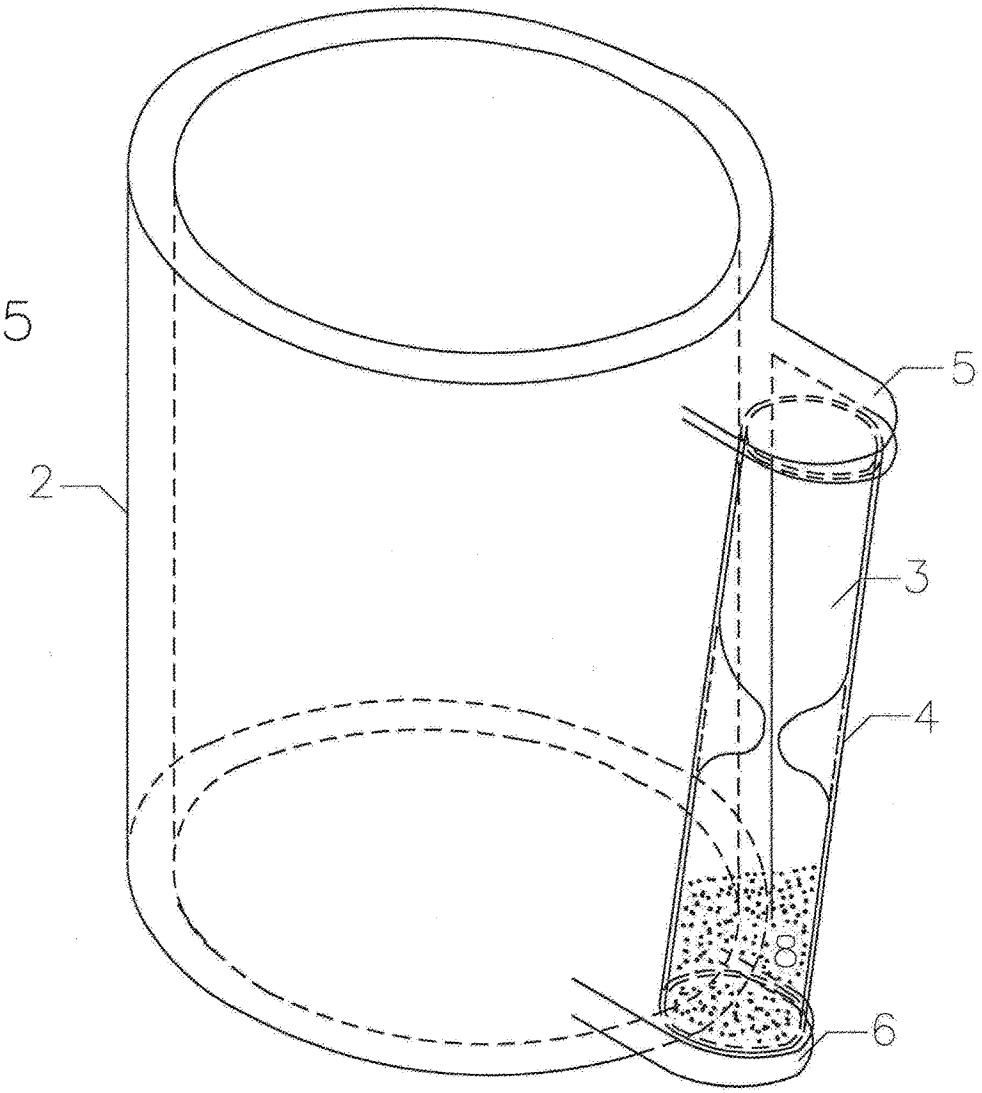

FIG. 1 shows the toothpaste tube 1, the open top and open bottom tubular toothpaste tube stand 2 formed of one piece construction, preferably recycled plastic, (but may be constructed of other rigid materials including new resin plastic, ceramic, glass and metal), a sand/oil liquid 8 timer hourglass 3 brushing timer completely enclosed within a clear plastic protective safety canister 4, adhesively attached to, and stationary between a protruding upper mounting tab 5 and protruding lower mounting tab 6, and said tubular stand 2 is intended to be vertically placed on the top surface of a bathroom countertop 7 where people routinely brush and clean their teeth.

FIGS. 2, 3, 4 and 5 show in detail the open top and open bottom tubular toothpaste tube stand 2 formed of one piece construction, preferably recycled plastic, (but may be constructed of other rigid materials including new resin plastic, ceramic, glass and metal), which may have varying tubular shapes, is vertically arranged, with an approximate 2⅝ inch tubular diameter, an approximate ¼ inch tubular wall thickness, and is of varying tubular heights to accept a plurality of toothpaste tubes 1. Manufactured toothpaste tubes range in length from approximately 3 inches to approximately 8 inches, all of which can fit within this appliance.

The design allows for the vertical placement of a toothpaste tube 1 within the opened top tubular stand 2, so the said toothpaste tube's nozzle end is placed downward within the tubular stand 2 with said tube's nozzle resting on the countertop 7. This placement facilitates the gravitational concentration of the toothpaste, within the toothpaste tube 1, toward the tube's nozzle end. This also positions the toothpaste tube 1 with its heat-fused end vertically upward within the tubular stand 2 and allows the user to apply grasping pressure to the toothpaste tube 1 near the heat-fused tube end, further concentrating the toothpaste, within the toothpaste tube 1, toward the tube's nozzle end.

A sand/oil liquid timer hourglass 3 is completely enclosed within a clear plastic protective safety canister 4, and has an approximate diameter of ½ inch, and an approximate height of 3 inches, and is adhesively attached to the protruding upper mounting tab 5 and the protruding lower mounting tab 6, and is therefore stationary on the side of the tubular stand 2. The sand/oil liquid 8 timer hourglass 3 and protective safety canister 4 are mounted at an approximate 10 degree vertical angle with respect to the horizontal axis of the tubular stand 2. This angular placement facilitates the user's view of the sand/oil liquid 8 timer hourglass 3 when viewed from a position either higher or lower than the direct horizontal view of the said tubular stand 2. The sand/oil liquid 8 timer hourglass 3 is actuated when the user picks up the open top and open bottom tubular stand 2 from the countertop 7 and rotates the entire appliance vertically 180 degrees, thereby placing the tubular stand 2 on its opposite end on top of the countertop 7. Performing this rotational movement allows the previous open bottom of the tubular stand 2 becomes the open top of the tubular stand 2, and vise versa.

Decorative designs may be placed on the front exterior surface and rear exterior surface of the tubular toothpaste tube stand 2. The decorative graphics should be displayed upward facing on the front side of the tubular stand 2, and upside-down (inverted) facing on the rear side of the tubular stand 2, so when the appliance is rotated 180 degrees vertically, a readable and/or understandable graphic image will face the user.

Figure 6:
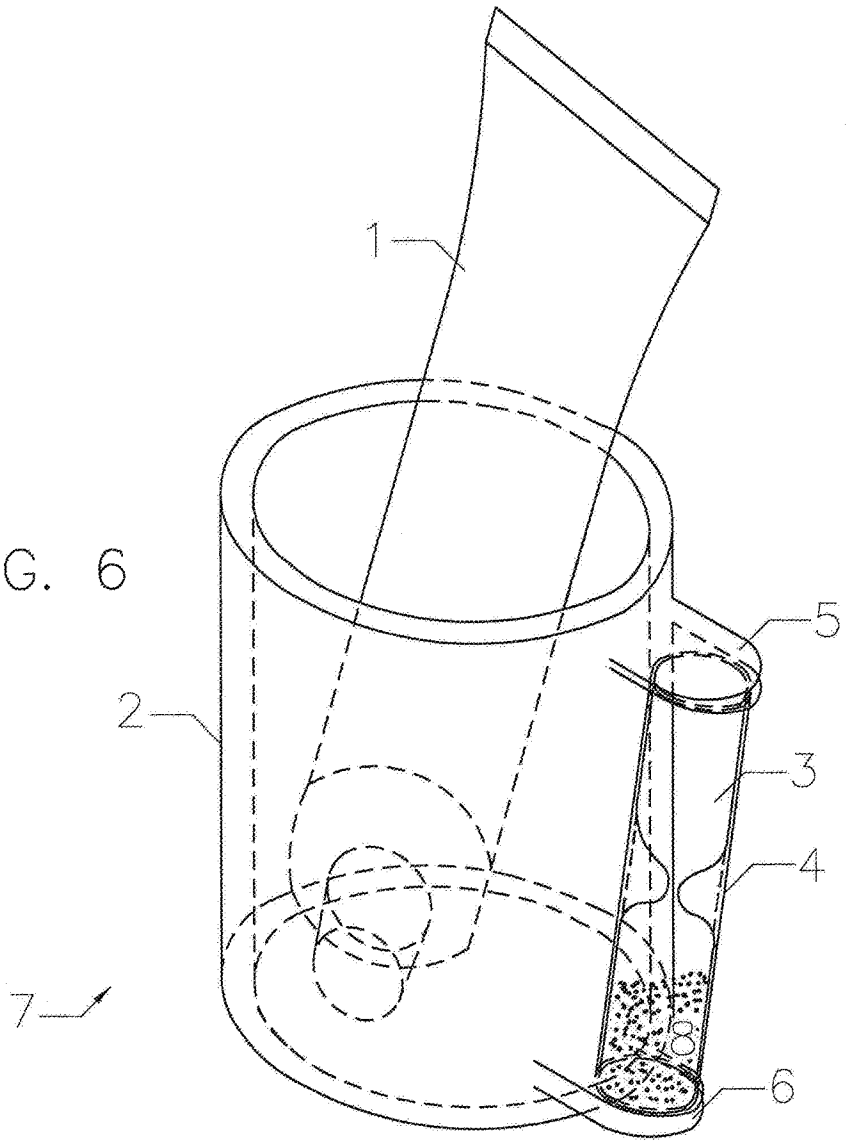
FIG. 6 is shown on sheet numbered 6-6 as a perspective view of the Tubular Toothpaste Tube Stand with Brushing Timer with a vertically standing toothpaste tube.

FIG. 6 shows the open top and open bottom tubular toothpaste tube stand 2 with a sand/oil liquid 8 timer hourglass with a vertically standing toothpaste tube. Hidden lines are shown of the vertically positioned toothpaste tube 1 to depict how the said toothpaste tube 1 rests within the said tubular stand 2 and on said countertop 7.

In practice, the user grasps the heat-fused end of the toothpaste tube 1 with their fingers and removes the toothpaste tube 1 from the top of the tubular stand 2. The user applies toothpaste from the toothpaste tube 1 to their toothbrush. The user picks up the tubular stand 2 in its entirety from the countertop 7, and vertically rotates the appliance 180 degrees, placing the tubular toothpaste tube stand 2 on its opposite open end on the countertop 7. This rotational movement actuates the attached, and stationary, sand/oil liquid 8 timer hourglass 3 causing the sand/oil liquid 8 to sift or flow within the timer hourglass 3 over a set duration.

The user then returns the toothpaste tube 1 into the open top of the tubular stand 2, nozzle end downward, while applying pressure to the toothpaste tube 1 near its heat-fused end. This act helps to concentrate the toothpaste within the toothpaste tube 1 toward the tube's nozzle end. The user brushes their teeth while occasionally glancing at the sand/oil liquid 8 timer hourglass 3 gauging the elapsed time. When the sand/oil liquid 8 has completely sifted or flowed within the timer hourglass 3 from its upper glass bulb into its lower glass bulb, the teeth-brushing and teeth-cleaning process is complete.

What is claimed is:

1. A tubular tooth paste Tube Stand with Brushing Timer appliance comprising; the tubular toothpaste tube stand having a circular open top and circular open bottom, the stand being capable of receiving an object placed therein in either an upright vertical position or when fully rotated 180 degrees, said stand having two protruding upper and lower mounting tabs on an outer side of the tubular stand for receiving a stationary and affixed sand/oil liquid timer hourglass which is enclosed within a clear plastic protective safety canister; and Said two protruding mounting tabs are positioned at vertically spaced and horizontally offset locations, relative to the horizontal axis of said stand, to provide for user viewing of said timer hourglass, from positions above and below said stand, with respect to the horizontal axis of said stand; and Said two protruding mounting tabs are further positioned to provide front, rear and side views of said timer hourglass, with respect to said mounting tabs on said stand.

2. The appliance of claim 1 wherein said stand and said timer provides for an assembly kit for interactive learning comprising the steps of:

While holding the tubular toothpaste tube stand, adhesively affixing the timer hourglass between the upper and lower mounting tabs, Adhesively affixing the clear plastic protective safety canister between the upper and lower mounting tabs, Placing decorative designs on the tubular toothpaste tube stand.

3. The appliance in claim 1 wherein said stand's open bottom allows interior cleaning thereof.

4. The appliance in claim 1 wherein said stand's open bottom allows water, loose toothpaste, and other debris within said stand to pass through said stand to a countertop surface, on which said stand resides.

5. The appliance in claim 1 wherein the upper and lower mounting tabs each include a facing surface oriented at an approximate 10 degree vertical angle with respect to a horizontal axis of the tubular stand.

* * * * *